US005360229A

United States Patent [19]

Arduin et al.

[11] Patent Number: 5,360,229

[45] Date of Patent: Nov. 1, 1994

[54] INTERFACE DEVICE DESIGNED TO MODIFY THE NATURAL PRESSURE DISTRIBUTION OF A SKI ON ITS SLIDING SURFACE

[75] Inventors: Joel Arduin, Metz-Tessy; Gilles Renaud-Goud, Annecy, both of France

[73] Assignee: Salomon S.A., Courbevoie, France

[21] Appl. No.: 46,948

[22] Filed: Apr. 15, 1993

[30] Foreign Application Priority Data

Apr. 17, 1992 [FR] France ..... 92 04963
Apr. 17, 1992 [FR] France ..... 92 04964

[51] Int. Cl.[5] ..... A63C 9/08

[52] U.S. Cl. ..... 280/617; 280/633; 280/634

[58] Field of Search ..... 280/601, 602, 607, 611, 280/617, 618, 633, 634, 636

[56] References Cited

U.S. PATENT DOCUMENTS 4,061,356 12/1977 Salomon ..... 280/605
5,211,418 5/1993 Scherübl ..... 280/618
5,222,756 6/1993 Gorza ..... 280/617 X

FOREIGN PATENT DOCUMENTS 0182776 5/1986 European Pat. Off. .
0437172A1 7/1991 European Pat. Off. .
0437172 7/1991 European Pat. Off. .
2654635 5/1991 France .
2654636 5/1991 France .

OTHER PUBLICATIONS

EPO Search Report of 93 10 4932.

*Primary Examiner*—Richard M. Camby
*Assistant Examiner*—Michael Mar
*Attorney, Agent, or Firm*—Pollock, Vande Sande & Priddy

[57] ABSTRACT

Interface device between a boot and a ski designed to modify the natural distribution of the ski on the snow along the line of a vertical thrust force which at least one part of the boot generates on the ski. The device comprises a vertically-mobile sensing device (11) which absorbs the vertical stresses from the boot, a rocker (16), and a transmission device (21) which transforms the vertical stresses of the boot into a forward-directed force of thrust. The transmission device (21) is connected to the base (25) in a zone raised off the upper ski surface. The transmission device (21) is connected to a transmission element (31) which travels longitudinally in relation to a stationary element (30), and a deformable means (38) blocks relative motion of the transmission element (31) in relation to the stationary element (30).

10 Claims, 7 Drawing Sheets

INTERFACE DEVICE DESIGNED TO MODIFY THE NATURAL PRESSURE DISTRIBUTION OF A SKI ON ITS SLIDING SURFACE

FIELD OF THE INVENTION

The invention concerns an interface device positioned between a boot and a ski, in particular an alpine ski, in order to modify the natural pressure distribution of the ski on its sliding surface.

More specifically, the invention concerns an interface device which transforms the vertical force which at least one portion of the boot exerts on the ski into a moment of flection which tends to cause at least one end of the ski to dip toward the sliding surface.

BACKGROUND OF THE INVENTION

In conventional fashion, a boot is held on a ski by a front and a rear binding. The ski itself possesses a certain degree of flexibility, which arises mainly from its internal structure. During skiing, the ski bends as a result of the stresses to which it is subjected by the skier, but also because of the ground on which it slides. Ski flection can be influenced by the reaction produced on the ski by the bindings. It is also possible to affect ski flection using a static stiffening piece or means which act dynamically on the ski. The invention relates to dynamic devices, i.e., those which, during the sliding motion, can transform at least a portion of the boot-induced stresses in the direction of the ski into a moment of flection which tends to cause at least one end of the ski to dip toward the snow.

A device of this kind was described in unpublished French Patent Applications Nos. 91 10895 and 91 15612, in Applicant's name.

These devices comprise a sensor component mobile vertically and capable of picking up the stresses which one end of the boot exerts toward the ski during the sliding motion. It further incorporates linkage means which transform these stresses into a force directed approximately along the longitudinal direction of the ski. A transmission device transmits this force to at least one of the binding bases, where it engenders a moment of flection tending to cause the end of the ski to dip toward the snow.

In these devices, the connection linking the transmission device to the base of the binding is a direct transmission, most often in a jointed arrangement. This transmission gives good results, but lacks flexibility and, in addition, is reversible; that is, the flective stresses of the ski, caused, for example, by the ground, can be retransmitted back to the linkage means and the sensor device, a phenomenon which is not always desirable.

SUMMARY OF THE INVENTION

One of the purposes of the present invention is to propose a device which surmounts this difficulty and a more flexible connection between the transmission device and the ski.

Another purpose of the invention is an interface device which exerts a limited action on the ski, especially in the case of pronounced stresses generated by the boot in the direction of the ski.

Another purpose of the invention is to propose a device which damps or filters vibrations that may be generated at one of the ends of the ski, while preventing them from being transmitted back in their entirety toward the linkage mechanism and the sensor device.

Other purposes and advantages of the invention will emerge from the following non-limiting description provided for informational purposes.

The interface device between a boot and a ski, intended to modify the natural distribution of the ski on the sliding surface in the direction of the force of vertical thrust which at least one part of the boot exerts on the ski, the boot being held in place on the ski, respectively, by a front and a rear binding assembled to the ski by a base, the device comprising means for absorbing the stresses between the boot and the ski, linkage means for transforming these stresses into at least one force or thrust directed approximately longitudinally toward at least one of the tips of the ski, and a transmission device which transmits the longitudinal force to the base of the binding located on the side facing the aforementioned end of the ski, the transmission mechanism being connected to the base of the binding in an area raised in relation to the upper surface of the ski, is characterized by the fact that the linkage device is connected to a longitudinally mobile transmission element in the base, and that a deformable element opposes relative movement of the mobile transmission element in relation to the upper surface of the ski along a longitudinal line in the direction in which the longitudinal force is directed.

BRIEF DESCRIPTION OF THE DRAWINGS

The invention will be better understood by referring to the description below and to the attached drawings, which form an integral part of the latter and in which.

DESCRIPTION OF THE PREFERRED EMBODIMENT

Figure 1:
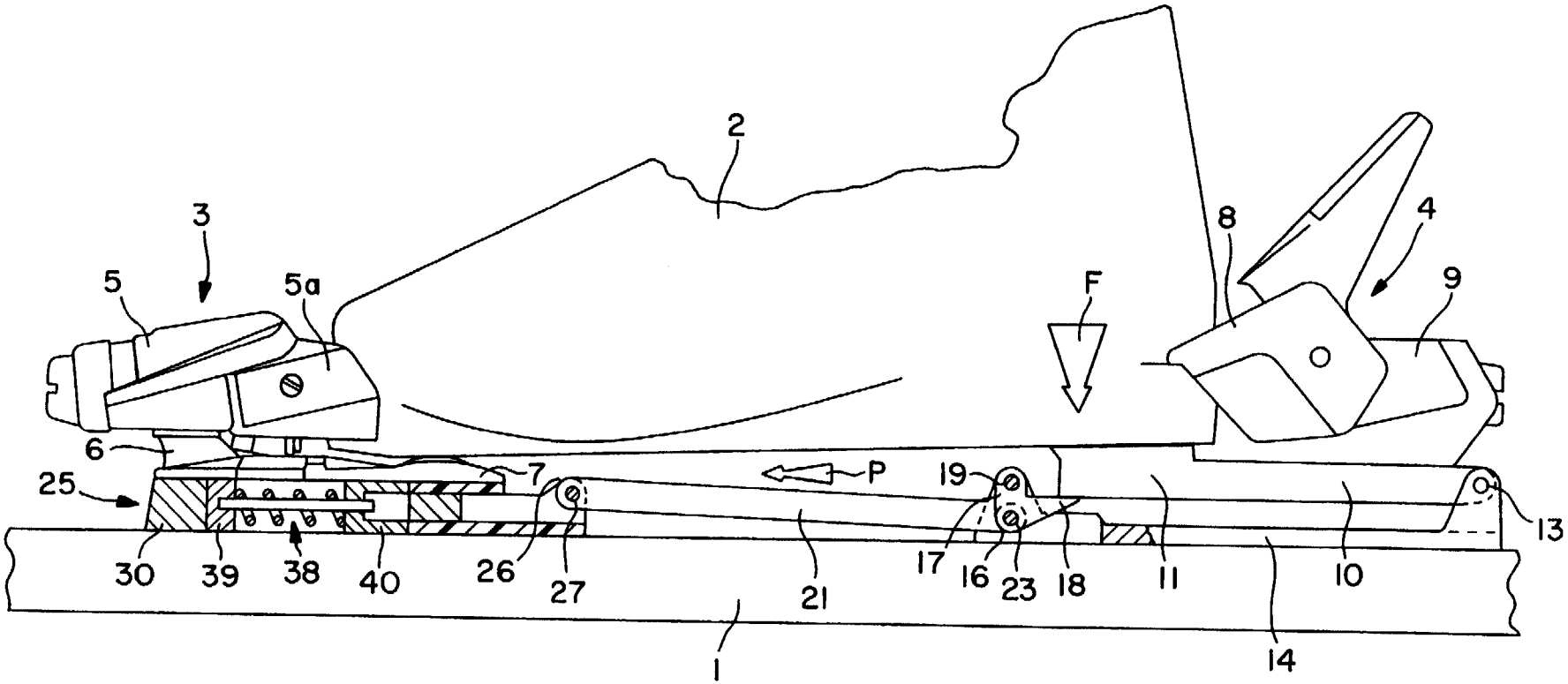
FIG. 1 is a schematic side view of an interface device according to a first embodiment of the invention.

FIG. 1 illustrates the area of the runner of a ski 1, on which a boot 2 is held in place between a front binding 3 and a rear binding 4. The front and rear bindings are of any suitable type. In conventional fashion, the front binding 3 incorporates a position-retention device 5*a* borne by a body 5, and a base plate 6 which rests on a base 25, by means of which the binding is assembled to the ski. The base plate 6 is extended rearward by a support plate 7, on which the front end of the boot sole rests. Similarly, the rear binding 4 comprises a position-retention device 8 borne by a body 9. In conventional fashion, the body 9 is mobile along a base plate 10, and the base plate 10 is extended forward by a support plate 11 on which the rear end of the boot sole rests.

The interface device comprises a sensor component which can absorb stress generated by the boot, or a portion thereof, in the direction of the ski, and, inversely, the stresses generated by the ski toward the boot. In FIG. 1, the sensor component is constituted by the rear base plate 11, on which the rear end of the boot sole rests. The rear portion of the base plate 10 belonging to the binding comprising the rear base plate 11 is jointed in rotation around a pin 13 borne by a base 14 forming one piece with the upper surface of the ski. Accordingly, the base plate 10 and the support plate 11 performing the sensing function are mobile around the pin 13 and describe an approximately vertical movement. Of course, any other mechanism could be used to guide the sensing device 11 in its vertical movement.

Means may potentially be provided to limit upward the movement of the base plate 10.

The interface device further comprises linkage means which transform the boot stresses absorbed by the sensing element 11 into a force directed approximately longitudinally. In FIG. 1, the linkage means are shown as a double-arm rocker 16, one arm 17 approximately vertical and the other 18 approximately horizontal and extending rearward. The rocker 16 is jointed around a transverse pin 19 positioned in the upper portion of its vertical arm 17 and carried by the base 14. Moreover, the base plate 10 rests against the horizontal arm 18 of the rocker.

A transmission device 21 is jointed to the rocker 16 around a pin 23 located at the junction of the two arms 17 and 18, approximately beneath the pin 19. The transmission device extends toward the front binding 3. It is capable of withstanding a compression stress and, therefore, of transmitting to the binding 3 a force directed in an approximately longitudinal direction imparted by the rocker 16.

A vertical stress generated by the boot on the sensing device 11, illustrated schematically by the arrow F, tends to cause rotation of the rocker 16 around its axis 19, a phenomenon which gives rise, in the area of the transmission element 21, to a force directed toward the front, schematized by the arrow P.

Of course, the linkage mechanism and the transmission device just described are not restrictive for the invention, and any other means could be used. In particular, use could be made of a linkage mechanism which transforms the boot-generated stresses simultaneously into a force directed toward the front and a force directed toward the rear of the ski.

The front part of the transmission device 21 is connected to flection means which transform the longitudinal force P into a moment of flection which tends to cause the front tip of the ski to dip toward the sliding surface of the latter.

As shown in the Figures, the front binding 3 is assembled to the ski by means of a base 25, which extends approximately beneath the base plate 6 of the binding. In particular, the base 25 has a rear portion 26 raised in relation to the upper ski surface and to which the linkage mechanism 21 is connected, for example by means of a transverse hinge pin 27. In the Figures, the rear portion 26 of the base 25 is positioned to the rear of the base plate 7 of the front binding 3.

Accordingly, the transmission device 21 transmits the force P to the base 25 in any area which is raised in relation to the upper surface of the ski. The base thus generates on the ski a moment of flection tending to cause the front end of the ski to dip toward the sliding surface, thereby tending to improve momentarily the performance of the ski on the snow.

Figure 2:
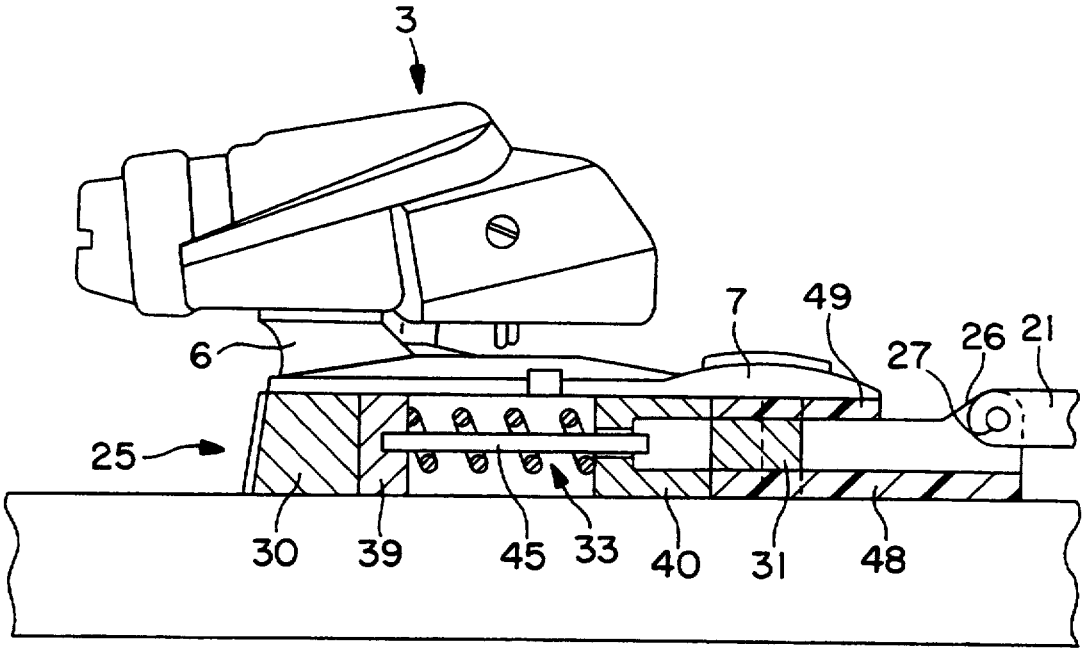
FIG. 2 is a schematic side view, in partial cross-section, of the front part of the interface device illustrated in FIG. 1.
Figure 3:
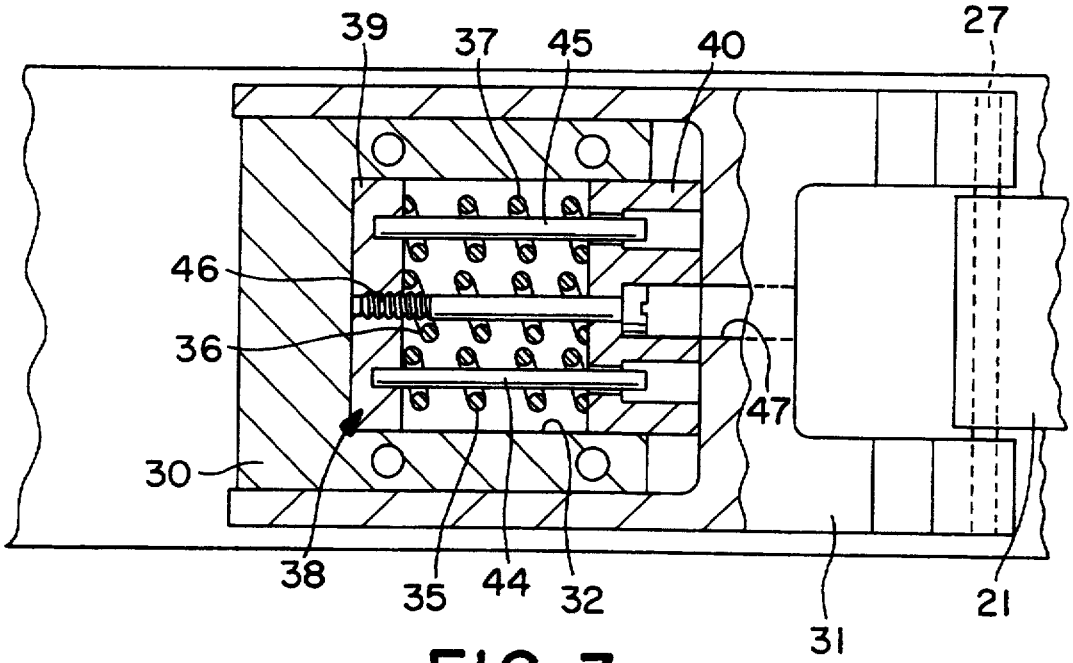
FIG. 3 is a top view in partial cross-section of the device illustrated in FIG. 2.
Figure 4:
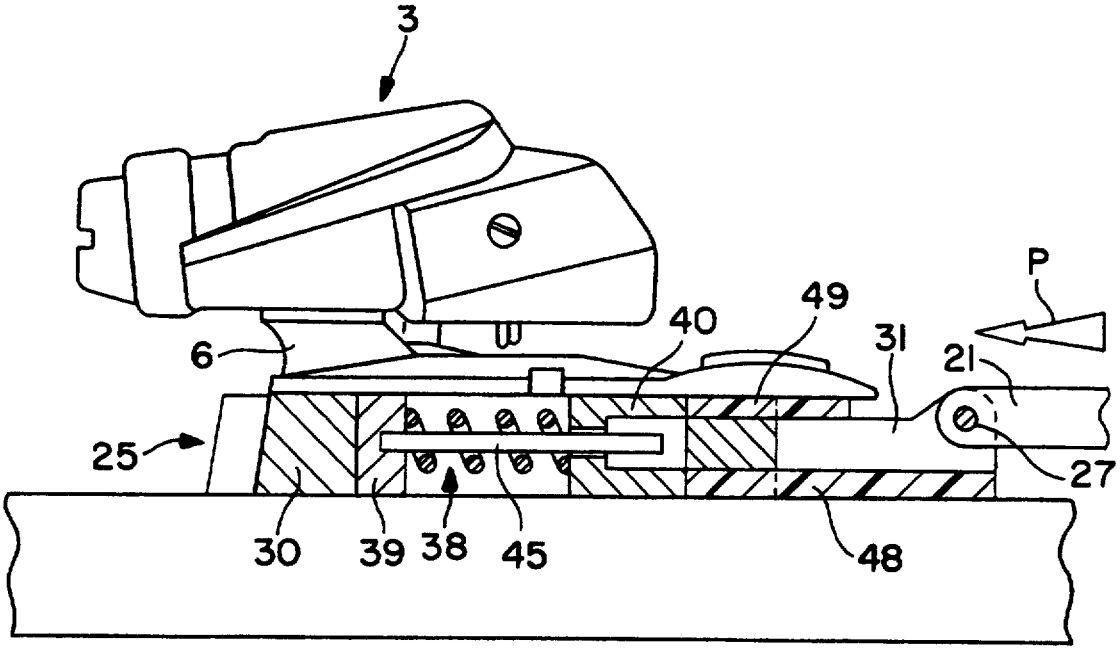
FIG. 4 is a view similar to that in FIG. 2, in another operating position of the interface device.

With reference more specifically to FIGS. 2 to 4, the base 25 comprises a stationary element 30 extending at least partially beneath the base plate 6 of the front binding 3, which is assembled to the ski using any suitable means, e.g., screws. The base plate 6 of the binding is assembled to the stationary element 30 using any suitable means, e.g., screws. These screws can pass completely through the stationary element 30 in order to effect its assembly to the ski, or else, the base plate and the stationary element can be assembled using separate screws.

In the embodiment illustrated, the stationary element 30 exhibits, as seen from above, a U shape opening downward and delimiting a recess in its central portion 32.

The base 25 further comprises a mobile transmission element 31, which can move freely in a longitudinal direction. In the example shown, the movable transmission element 31 is fitted on the stationary element 30 and is guided on the outside of this element so as to be capable of only one single longitudinal movement. The transmission device 21 is connected to the movable transmission element 31 belonging to the base 25 by means of the hinge pin 27 previously described, located in the rear portion 26 of the base 25, i.e., the mobile element 31.

The base 25 also comprises an elastic return mechanism 33 which opposes the translational movement of the transmission element 31 toward the front of the ski. In the example illustrated, the elastic return mechanism 33 is constituted by a battery of three springs 35, 36, and 37, mounted parallel to the longitudinal axis described by the ski. The springs are housed in the recess 32 in the stationary element 30. They are supported by one of their ends against the stationary element 30, and their other end is stressed by the movements of the transmission device 31, which the springs resist while generating an elastic return force. The springs are preferably calibrated; that is, they are prestressed and their length remains constant as long as the force applied by the transmission element 31 does not exceed a predetermined calibration value. As long as this force is less than the predetermined force, it is transmitted in its entirety to the base 25 and generates, in the area of that base, a moment of flection on the front end of the ski.

If the force applied by the transmission element 31 exceeds the predetermined calibration force, a part of this applied force is absorbed by the calibrated. This occurs when high levels of stress are generated by the boot toward the ski, or by the ski toward the boot. These stresses cause rotation of the rocker 16 and translational motion of the transmission device 21 over a relatively sizable amplitude. Compression of the springs 35 to 37 allows absorption of a portion of the energy engendered by this motion, and prevents the transmission device 21 from subjecting the base 25 to very high stresses, and the ski, to excessive moments of flection. It also prevents the interface device from reacting excessively when the ground subjects the ski to abrupt deformations, in particular shocks.

In other words, the energy created by movements of the sensing element as acted on by the stresses between the ski and the boot is transmitted to the base 25 by the transmission device 21.

Up to a predetermined value corresponding to the pretensioning of the springs, this energy is transmitted to the base 25, which behaves as though it were a one-piece element, and is transformed into a stress inducing flection of the front end of the ski.

Beyond the predetermined value corresponding to the pretensioning of springs 35 to 37, this energy is partially transformed into a moment of flection exerted on the front part of the ski, and is partially absorbed by the springs.

The moment of flection thus generated tends to cause the front end of the ski to dip toward the snow, thereby improving the traction on snow of the front part of the ski, when the skier places his weight on the rear.

In addition, if the front end of the ski is subjected to a flective stress which modifies the curvature of the ski, this stress is returned to the boot by means of the interface device, through the action of the springs, which produce a kind of filtering action. This flective stress is thus not directly transmitted upward in its entirety to the boot.

With reference to FIGS. 2 to 4, the springs 35 to 37 are mounted in a cartridge 38, which is positioned in the recess 32 in the stationary element 30. The cartridge is preferably interchangeable so as to allow use of springs having a different pretensioning and stiffness value.

Preferably, the cartridge 38 when at rest has a predetermined length. With reference to FIG. 3, the cartridge comprises a transverse stop 39 which rests against the stationary element 30 in the bottom of the recess 32. The cartridge also comprises a piston on the side facing the mobile element 31. The springs are placed between the stop 39 and the piston 40, and are preferably guided by longitudinal rods 44, 45, and 46. In the example shown, the central rod 46 is, in fact, a bolt which is screwed into the transverse stop 39 and whose head holds the piston 40 in place and prevents it from moving away from the transverse stop 39 beyond a predetermined distance.

The cartridge 38 is simply inserted between the stationary element 30 and the transmission device 31. These elements can thus be detached in order to pull out the cartridge and replace it with another, or to put back the same cartridge, for example after having modified its characteristics. In fact, it is possible to modify the properties of the cartridge by replacing the transverse stop 39 with another stop having a greater or lesser thickness. The pretensioning of the springs is actually determined by the parameters specific to the different springs used, but also by the distance separating the two opposite faces, one belonging to the transverse stop 39 and the other, to the piston 40.

In the assembly illustrated, it is also possible to adjust the calibrated pretensioning of the springs 35 to 37 by screwing the bolt 46. This causes movement of the transverse stop 39 tending to compress the springs 35 to 37. It is then the end of the bolt 46 which rests against the stationary element 30. The length of the cartridge thus remains constant. The hole 47 in the movable element 31 allows access to the head of the bolt 46.

Good results have been obtained using a cartridge whose pretensioning force was between 0 and 350 kilograms of force, and preferably between 30 and 80 kilograms of force. These values are obviously not restrictive.

In the embodiment shown in the Figures, the mobile element 31 incorporates, above and below, fittings 48 and 49 intended to facilitate its sliding motion.

FIG. 4 represents the cartridge 38, which the transmission device 21 and the transmission element 31 subject to a force exceeding the pretensioning force. The transmission element has caused a movement of the piston 40 toward the transverse stop 39, along the rods 44 to 46. This has compressed the springs 35 to 37.

As soon as the stress exerted by the boot disappears, the springs 35 to 37 push the piston and the transmission device and element back to their initial position.

Figure 5:
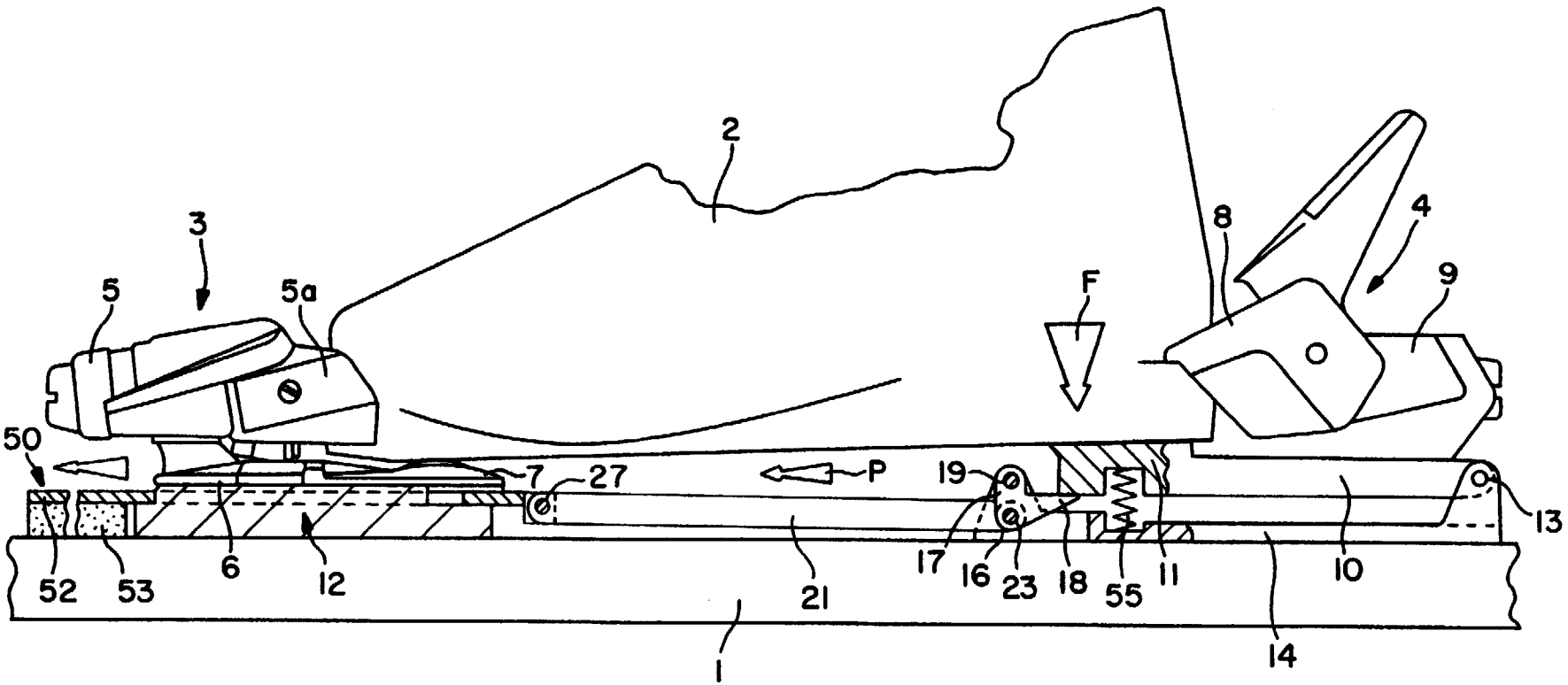
FIG. 5 is a side view illustrating schematically the interface device according to a second embodiment of the invention.
Figure 6:
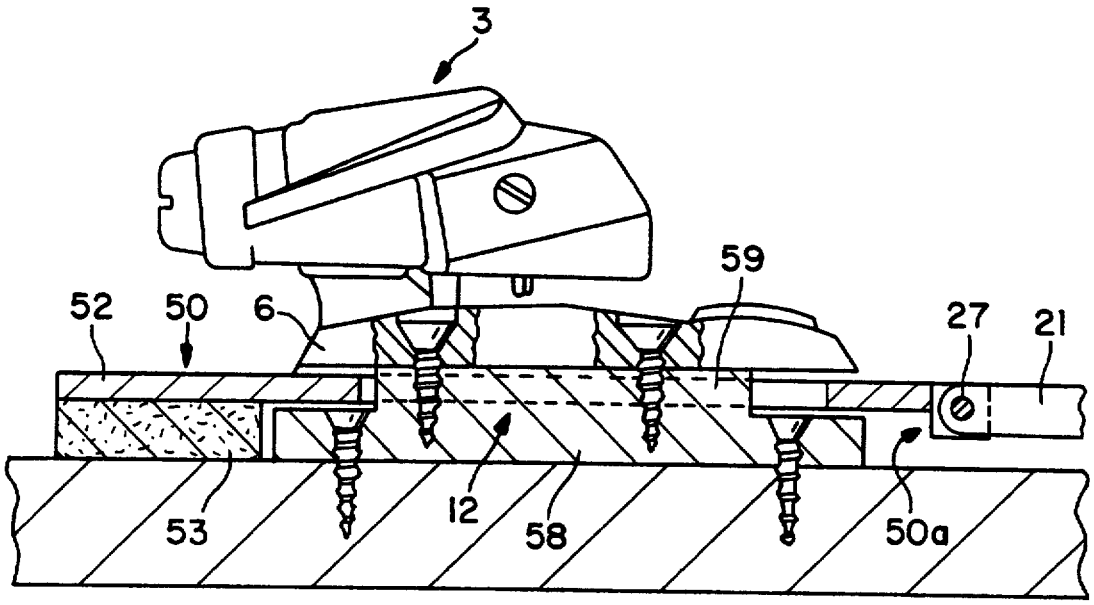
FIG. 6 is a side view of the device in FIG. 5, in the area of the front binding.

FIG. 5 illustrates a variant of the invention, in which the flection means comprise a transmission plate 50 which is raised in relation to the upper ski surface and substantially parallel to it. The transmission plate 50 is connected to the front end of the linkage device 21 around the transverse pin 27. From this pin 27, the transmission plate 50 extends beneath the base plate 6 of the binding 3, and is extended forward beyond the base plate 6 by a platform 52. The transmission plate 50 can slide freely in relation to the base plate 6 or the base 12, which supports this base plate and provides for assembly of the binding to the ski. This base will be subsequently described in detail.

A block of a deformable material 53 is mounted in a sandwich configuration between the platform 52 and the upper ski surface. The block 53 has the approximate shape of a parallelepiped, and is assembled using any suitable means, especially by adhesive bonding, to the platform 52 and to the upper ski surface.

The block of material 53 is provided in order to work under shear action, in particular to damp the longitudinal movements of the platform 52 in relation to the ski. The block 53 acts as a brake; i.e., it provides resistance to the relative movements of the platform 52 in relation to the ski. By reaction, it transmits to the ski the stress exerted on it by the platform 52 as a moment of flection. The block 53 preferably also possesses elastic and vertical shock-absorbing properties, so as to damp the vibratory movements produced at the front end of the ski. Accordingly, the stresses between the boot and the sensing device produce a movement a movement toward the front of the platform 52, this movement being transmitted to the ski through the block of material 53, which undergoes shear stress. This shear stress induces, on the front of the ski, a moment of flection tending to cause the front end of the ski to dip toward the sliding surface.

Figure 7:
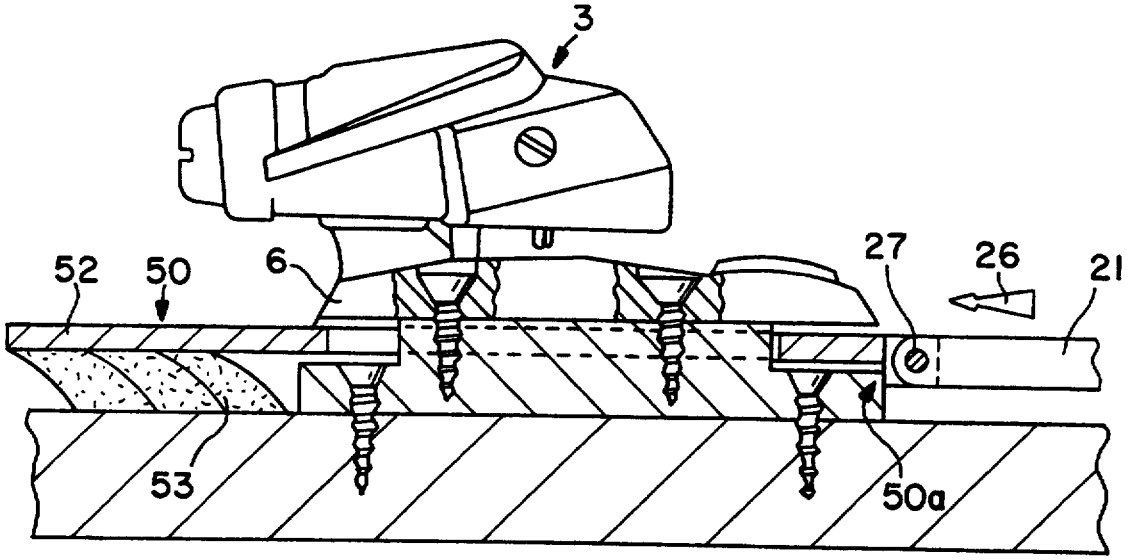
FIG. 7 illustrates the device in FIG. 6 in another working position.

FIG. 7 shows the front part of the device which, by undergoing forward translational motion, exerts shear stress on the block.

A stop preferably limits the forward motion of the transmission plate 50, so as not to produce excessive shear stress on the material 53. In the example shown, this stop is constituted by an edge (50*a*) of the transmission plate (50) which, after a determinate movement of translation, comes to rest against the base 12 of the binding 3.

Inversely, if the front end of the ski is subjected to flective stress, in particular because of the ground over which the ski slides, this stress is transformed into a compression stress exerted on the block 53, as well as a flective stress of the platform 52. In any event, this stress is not retransmitted directly and in its entirety back to the rocker 16 by the transmission device 21.

To facilitate the rearward return movement of the transmission plate (50) and the upward return movement of the sensing device 11 after exertion of a shear stress on the block 53, or to damp the downward motion of the sensing device 11, any suitable means, e.g., a spring 55, is placed between the base plate 10 and the base 14 of the rear binding 4, so as to exert on the base plate 10 an elastic force directed upward. The spring 55 could be replaced by a block of a viscoelastic damping material, or it could be positioned in parallel with a shock-absorbent block.

In this way is produced a vertical suspension movement of the rear end of the boot, which enhances, moreover, the skier's comfort.

The material composing the block 53 is of any suitable type and preferably possesses viscoelastic-type damping properties. Good results have been obtained using a material marketed under the tradename "SORBOTANE." The block preferably has dimensions of between 50 and 350 millimeters in length and 3 to 30 millimeters in thickness. Of course, these measurements are nonlimiting within the scope of the present invention, and are provided only for informational purposes.

Figure 8:
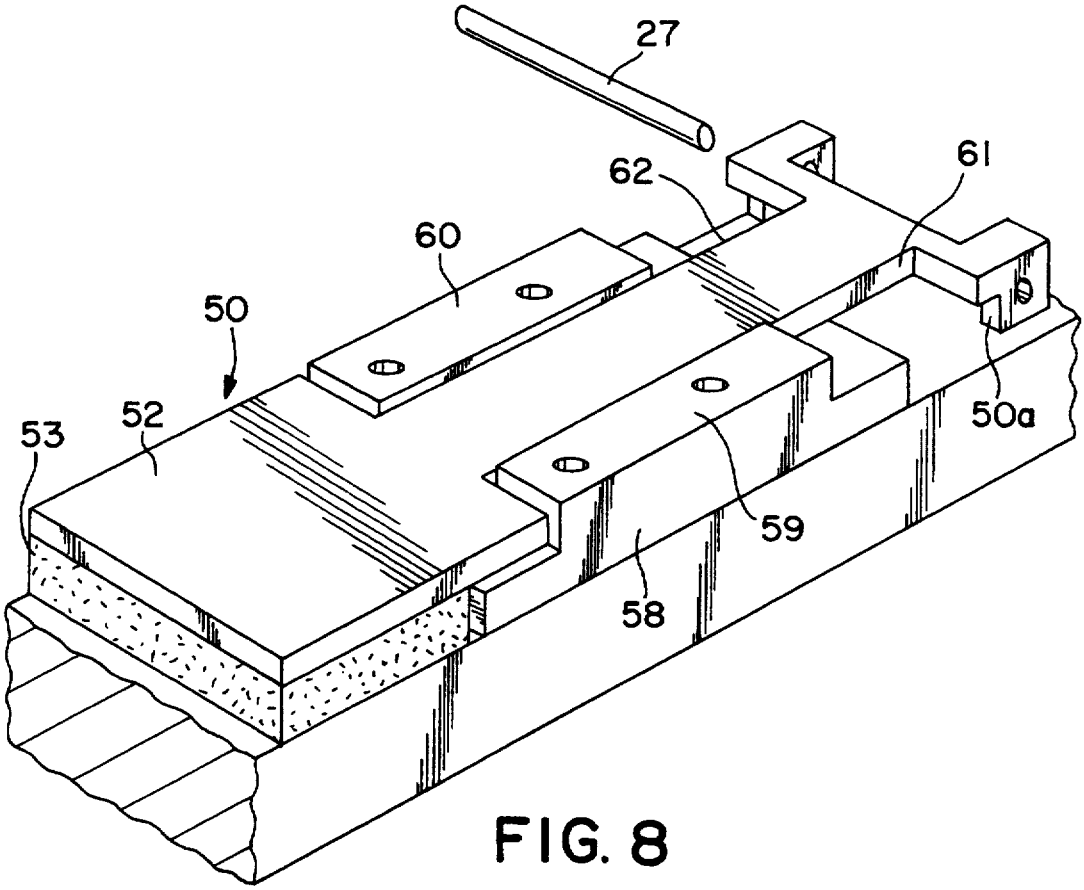
FIG. 8 is a perspective view illustrating the various components belonging to the front part of the interface device in FIG. 5.

FIG. 8 illustrates the base 12 by means of which the base plate 6 of the front binding 3 is assembled to the ski. It incorporates a block 58 assembled to the ski using any appropriate means, e.g., screws. The block 58 is surmounted by two lateral contact blocks 59 and 60, which pass through the thickness of the plate at the level of two lateral openings 61 and 62. The lateral contact blocks 59, 60 are designed to support the base 6 of the binding 3, and their lengthwise dimension makes it possible to position the base plate 6 at different points, as a function of the length of the sole of the boot.

The lateral sole plates 59 and 60 delimit between them a kind of groove, within which the portion of the transmission plate located between the two openings 61 and 62 is guided. The contact blocks 59 and 60 have, moreover, a length less than the length of the openings 61, 62 in the transmission plate 50 and a thickness which is slightly greater than that of the plate at this level, so that the transmission plate 50 can slide freely longitudinally and a transverse or vertical movement is blocked.

The support means are obviously not restrictive. Any other mechanism could prove suitable, so long as the transmission plate 50 can move freely, at least longitudinally, in order to exert shear stress on the block 53.

Figure 9:
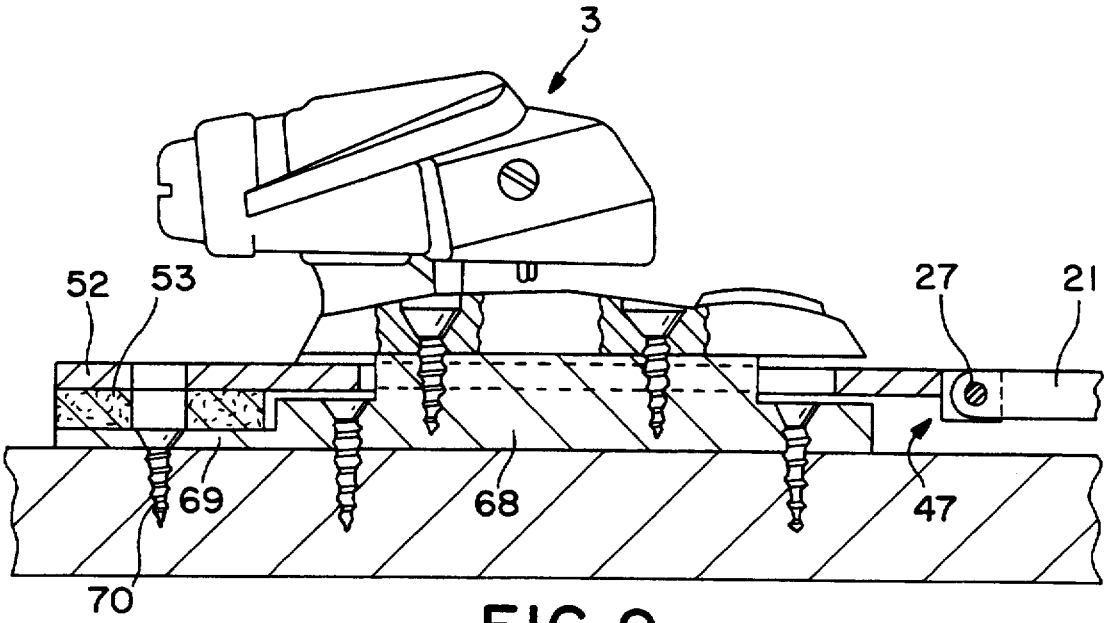
FIG. 9 illustrates another variant of the interface device in FIG. 5.

FIG. 9 illustrates a variant, in which the front binding 3 is assembled to the ski using a block 68, which is extended forward beneath the block of material 53 by a tongue 69. The block of material 53 is then mounted in a sandwich arrangement between the platform 52 of the transmission plate and this tongue 69. The block is integrally attached to each of these components using any appropriate means, e.g., adhesive bonding. Potentially, the integral attachment of the tongue 69 to the ski is reinforced with screws 70. This arrangement avoids having to bond the block of material 53 to the upper ski surface, thereby making it possible to mount the interface device easily on the ski, and, as required, to detach it without damaging the latter.

Figure 10:
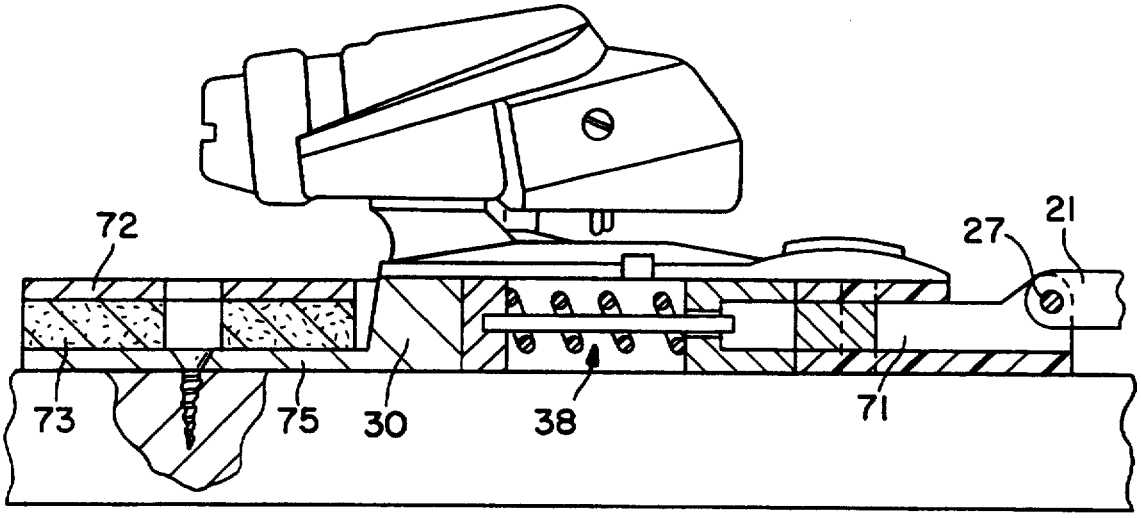
FIG. 10 is a schematic side view, in partial cross-section, of another variant.
Figure 11:
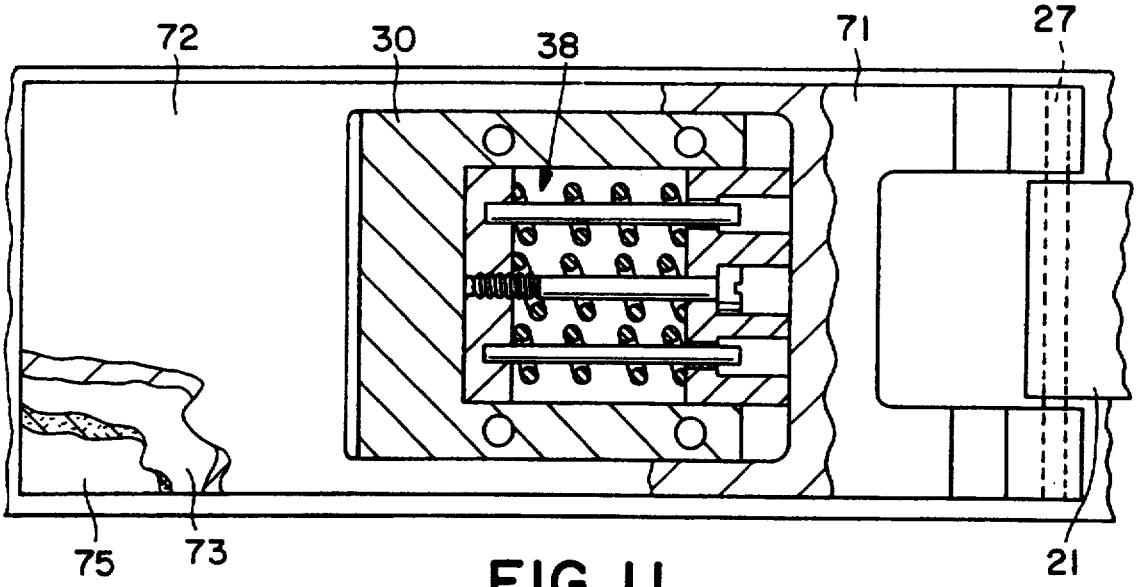
FIG. 11 is a top view of the device in FIG. 9.

FIG. 10 represents a variant in which the transmission device 21 is connected to a transmission element 71 of the same type as the transmission element 31; but this element 71 is extended forward beyond the base plate 6 by a platform 72, of the same type as the preceding platform 52 and raised off the upper ski surface. This platform 72 moves longitudinally in conjunction with the movements of the transmission element 71. A block of an elastically-deformable material 73 is mounted in a sandwich configuration between the platform 72 and the upper ski surface. As illustrated in the Figure, the stationary element 30 on which the base plate 6 is supported is preferably extended forward by a tongue 75, which is pressed against the upper ski surface, and the block 73 is mounted in a sandwich arrangement between the platform 72 and this tongue 75. The block 73 is assembled to these two elements using any suitable means, e.g., adhesive bonding. The material composing the block 73 is chosen in order to ensure that the block functions longitudinally under shear action. This shear action is generated by movement of the transmission element 71, as acted upon by a force greater than the pretensioning force of the springs housed in the cartridge 38. Preferably, the material making up the block 73 allows damping of certain vibrations generated at the front tip of the ski or as a result of its flective movements during the sliding motion.

For example, it would be possible to use a block 73 made of a material marketed under the tradename "SORBOTANE," whose length is between 50 and 350 millimeters, and whose thickness exceeds 5 millimeters. This specification is, of course, non-limiting for the invention.

The present description is provided only as an indication, and other embodiments could be adopted, while remaining within the scope of the invention.

In particular, it would be possible to equip the rear binding with a device similar to that described with reference to the front binding.

In addition, it is obvious that the stationary element 30 belonging to the base 25 could form an integral part of the binding 3 and constitute a one-piece element with its base plate 6.

Furthermore, it is evident that the base 12 could form an integral part of the front binding 3; i.e., it could constitute a one-piece element with the base plate 6. Moreover, the binding 3 could be assembled to the ski by means of a single set of screws which pass through the base plate 6 and the base 12.

As a further variant, it is evident that the rear tip of the ski could be equipped with a transmission plate and a block of an elastically-deformable material of the same kind as that constituting the plate 50 and the block 33.

In addition, the block of deformable material 53, 73 assembled by each of its faces to the platform 52, 72 and to the ski or tongue 69 integrally attached to the ski could be replaced by a layer of non-hardening glue possessing substantial prerupture elasticity.

What is claimed is:

1. An interface device between a boot and a ski intended to modify the natural pressure distribution of the ski on a sliding surface of the ski in the direction of a vertical thrust force which at least one portion of the boot exerts on the ski, said boot being held in place on the ski by a front binding (3) and a rear binding (4), each of said bindings being assembled to the ski by respective bases (12,14), said interface device comprising a sensor device (11) intended to absorb stresses between said boot and said ski, linkage means (16) for transforming said stresses into at least one force of thrust directed approximately longitudinally to at least one of the ends of the ski, and a transmission device (21) intended to transmit the longitudinal force to said base (25) of said front binding (3) on a side facing one end of said ski, said transmission device (21) being connected to said base of said front binding in a zone raised off an upper surface of the ski, wherein said transmission device (21) is connected to a longitudinally movable transmission element (31, 50, 71) of said base of said front binding, and a deformable element (38, 53, 73) which opposes the relative motion of said movable transmission element in relation to the upper ski surface and longitudinally in the direction of the longitudinal force.

2. Device according to claim 1, wherein said deformable element (38) comprises at least one spring (35, 36, 37) resting, at one of its ends, against a stationary element (30) belonging to said base (25) of said front binding, and at the other end, against the mobile transmission element (31, 71).

3. Device according to claim 2, wherein the pretensioning of said deformable element (38) is calibrated and said linkage element (31, 71) travels in relation to said stationary element (30) only when the force transmitted to it is greater than the calibrated force of said deformable element.

4. Device according to claim 3, wherein said calibrated force of said deformable element is between 30 and 80 kilograms of force.

5. Device according to claim 1, wherein said base (25) of said first binding incorporates a stationary element (30) supporting the binding (3), said movable transmission element (31) which slides longitudinally in relation to said stationary element, and said deformable element, which includes an energy cartridge (38) positioned in a recess (32) in said stationary element (30) and elastically resisting the movement of said movable transmission element (31) toward said stationary element (30).

6. Device according to claim 5, wherein said stationary element (30) belonging to said base (25) is extended beneath said platform (52) by a tongue (69) pressed against the upper ski surface and said block of elastically deformable material (43) is inserted between said platform (52) and said tongue (69).

7. Device according to claim 1, wherein said mobile transmission element (50, 71) is extended beyond the binding by a platform (52, 72) raised off the upper ski surface and said deformable element is a block of deformable material (53, 73) mounted in a sandwich configuration between said platform (52, 72) and the upper ski surface.

8. Device according to claim 7, wherein said block of elastically-deformable material (53, 73) is provided so as to work under longitudinal shear action.

9. Device according to claim 8, wherein said block of elastically deformable material (53, 73) extends over a length of 50 to 300 millimeters.

10. Device according to claim 1, wherein said deformable element comprises at least one spring (38) and a block of deformable material (73) subjected simultaneously to stress by a movable transmission element (71).

* * * * *

UNITED STATES PATENT AND TRADEMARK OFFICE

CERTIFICATE OF CORRECTION

PATENT NO. : 5,360,229

DATED : November 1, 1994

INVENTOR(S) : Arduin et al

It is certified that error appears in the above-indentified patent and that said Letters Patent is hereby corrected as shown below:

On title page, item [73], change "Salomon S.A., Courbevoie, France" to

--Salomon S.A., Annecy, France--.

Signed and Sealed this

Sixteenth Day of May, 1995

*Attest:*

Bruce Lehman

BRUCE LEHMAN

*Attesting Officer*

*Commissioner of Patents and Trademarks*